US010317038B2

(12) United States Patent
Vosmik et al.

(10) Patent No.: US 10,317,038 B2
(45) Date of Patent: Jun. 11, 2019

(54) COOLER OF A LIGHT SOURCE

(71) Applicant: Varroc Lighting Systems, s.r.o., Senov u Noveho Jicina (CZ)

(72) Inventors: Jan Vosmik, Frydek-Mistek (CZ); Jaroslav Hasa, Bernartice nad Odrou (CZ)

(73) Assignee: VARROC LIGHTING SYSTEMS, Senov u Noveho (CZ)

( * ) Notice: Subject to any disclaimer, the term of this patent is extended or adjusted under 35 U.S.C. 154(b) by 454 days.

(21) Appl. No.: 15/085,633

(22) Filed: Mar. 30, 2016

(65) Prior Publication Data

US 2016/0290590 A1 Oct. 6, 2016

(30) Foreign Application Priority Data

Mar. 31, 2015 (CZ) ..... 2015-226

(51) Int. Cl.
*F21S 45/43* (2018.01)
*F21Y 115/10* (2016.01)
*F21S 45/47* (2018.01)

(52) U.S. Cl.
CPC ..... *F21S 45/43* (2018.01); *F21S 45/47* (2018.01); *F21Y 2115/10* (2016.08)

(58) Field of Classification Search
CPC ..... F21V 29/60; F21V 29/67–677; F21S 48/323; F21S 48/325
See application file for complete search history.

(56) References Cited

U.S. PATENT DOCUMENTS 7,682,054 B2 * 3/2010 Hsu ..... F21S 6/003 362/294
7,837,363 B2 * 11/2010 Liu ..... F21V 29/004 362/373

(Continued)

FOREIGN PATENT DOCUMENTS

DE 102005038186 A1 2/2007
DE 102007043961 A1 3/2009

(Continued)

OTHER PUBLICATIONS

Search Report from Corresponding Czech Application PV 2015-226 dated Nov. 6, 2015 (3 pages).

(Continued)

*Primary Examiner* — Julie A Bannan
(74) *Attorney, Agent, or Firm* — Hovey Williams LLP

(57) ABSTRACT

A cooler of a light source, especially for a motor vehicle lamp, mounted in a light source holder (2) arranged in a thermally conductive cooling monobloc (11), is fitted with cooling elements for heat dissipation, and is equipped with channels (14, 17, 18, 19) for supplying cooling media from cooling media source (21) to the cooling first side (3) of the light source holder, the light source (1) being mounted on the opposite side (4) thereof. Main channel (14) is arranged with the cooling media flow direction in parallel to longitudinal axis of cooling monobloc, and at least one secondary channel leads into the main channel under the light source holder first side. The secondary channel can lead into the area under the light source holder first side. Secondary channels can at least partly comprise removable covers fitted with inner guiding and cooling fins (23, 24) and/or outer cooling fins.

5 Claims, 5 Drawing Sheets

(56) References Cited

U.S. PATENT DOCUMENTS

| | | | | |
|---|---|---|---|---|
| 8,304,970 | B2 * | 11/2012 | VanderSluis | F21S 8/02 313/35 |
| 2005/0111234 | A1 * | 5/2005 | Martin | F21S 6/003 362/555 |
| 2006/0181894 | A1 * | 8/2006 | Chinniah | F21V 31/03 362/547 |
| 2007/0084585 | A1 | 4/2007 | Takagi et al. | |
| 2007/0091632 | A1 * | 4/2007 | Glovatsky | B60Q 1/0052 362/547 |
| 2009/0059559 | A1 * | 3/2009 | Pabst | F21V 29/677 362/84 |
| 2009/0262550 | A1 * | 10/2009 | Inoue | F21V 29/677 362/547 |
| 2010/0091486 | A1 * | 4/2010 | Wu | F21K 9/00 362/234 |
| 2010/0124071 | A1 * | 5/2010 | Lee | B61D 29/00 362/516 |
| 2010/0181888 | A1 * | 7/2010 | Lu | F21V 3/02 313/46 |
| 2010/0264826 | A1 | 10/2010 | Yatsuda et al. | |
| 2011/0051453 | A1 * | 3/2011 | Nagasawa | B60Q 1/007 362/547 |
| 2014/0268827 | A1 * | 9/2014 | Schwarz | F21V 15/01 362/373 |

FOREIGN PATENT DOCUMENTS

| | | | |
|---|---|---|---|
| EP | 2187121 | | 5/2010 |
| FR | 2996905 | | 4/2014 |
| JP | 2009129642 | A | 6/2009 |
| JP | 2010272440 | A | 12/2010 |
| SE | 519150 | C2 | 1/2003 |

OTHER PUBLICATIONS

Office Action from corresponding German Application No. 10 2016 105 530.1 dated Mar. 1, 2018, and machine English translation (7 pages).

* cited by examiner

COOLER OF A LIGHT SOURCE

FIELD OF THE INVENTION

The invention relates to a cooler of a light source, especially a planar light source of a motor vehicle lamp, mounted in the holder of the light source, arranged in a heat conductive cooling monobloc, fitted with cooling elements for dissipation of heat.

BACKGROUND OF THE INVENTION

Lamps of motor vehicles produced at present use powerful light emitting diodes (LED's), which however heat up strongly during operation and issue high amounts of heat. The high temperature of LED's has a negative influence of the properties of semiconductors, which form the principal components of LED's. A higher working temperature reduces both the instantaneous luminous intensity of LED's and their service life. Therefore, intensive cooling of LED's is essential for proper functioning of light sources of the above mentioned type. What also needs to be provided is reliable mounting in the cooling monobloc and ingress protection of electric components. To reduce the temperature of LED's, coolers are used that are fixed to the structure of the lamp or the entire lamp body is used as a cooler. A commonly used material for a LED light source coolers is aluminum because it features high thermal conductivity, which ensures quick dissipation of heat from the heated part to other, colder parts.

Some designs are also known from, the prior art when the cooler of a light source is made of a thermally conductive plastic material. Thermal conductivity of a plastic material is substantially lower than that of an aluminum, cooler and the need to dissipate excessive heat is more urgent in the case of plastic material. Excessive heat is also dissipated from the light source by transfer to the ambient air. Due to high demand of the cooling media the cooling system must be equipped with a powerful cooling media source, e.g. a fan. On the other hand, plastic-based materials make it possible to produce complex components by compression moulding with good dimensional tolerances and very good surface finish. Another advantageous property is their design flexibility, which eliminates the need of final treatment of the surface and many assembly operations.

The document EP2187121 discloses a cooler of the light sources of optical modules of lighting devices of motor vehicles arranged next to each other, comprising optical modules arranged next to each other, each of them comprising a plate holder with a planar light source. The plate holders of the optical modules arranged next to each other are mutually connected with thermally conductive bridges for better temperature distribution and the thermally conductive bridges are equipped with cooling fins for heat dissipation. The plate holders of the planar light sources and the cooling fins form cooling monoblocs. The cooling fins are cooled by the ambient air. A disadvantage is a complex design of the cooler and insufficient dissipation of heat from the light source. A disadvantage of this design is also the fact that it uses a material with high thermal conductivity, which is associated with high financial demands. Also, the possibilities of the metal working technology are limited. The limited possibilities of the technology of machining of highly thermally conductive materials have a significant impact on the final shape and structural arrangement of the cooler. It is often necessary to adapt, the other components of the lighting device to the shape and dimensions of the cooler.

The document FR2996905 discloses a light device for motor vehicles with flat LED light sources mounted for heat distribution on a thermally conductive plate made of a plastic material with higher thermal conductivity than 1 W m−1° K.−1. To improve cooling of the thermally conductive plate the plate is fitted with a row of cooling fins arranged next to each other on the side that is averted from the light source. However, the efficiency of heat dissipation is very low as the light sources are cooled by mere blowing of air over the light sources and the other side of the thermally conductive plate is not exposed to streaming air.

The goal of the invention is a cooler of a planar light source that will have higher efficiency of heat transfer from the light source to the cooling media, and that will dissipate more heat from the light source on the whole. The goal of the invention is further such an arrangement of the cooler of the planar light source that will enable an easy replacement of the light source, easy association of the lamp reflector and cooling media source, and that will have a cooling monobloc with an integral and compact design. Also, the goal of the invention is to improve concentration of the streaming cooling media around the light source. Finally, the final goal of the invention is to achieve a simple design of the cooler of the planar source and shape flexibility of its parts during production.

SUMMARY OF THE INVENTION

The disadvantages of the prior devices are substantially eliminated and the goal of the invention is fulfilled by a cooler of a light source, especially a planar light source of a motor vehicle lamp, mounted in the holder of the light source, and arranged in a thermally conductive cooling monobloc. This cooling monobloc is fitted with cooling elements for heat dissipation according to the invention, the principle of which is that the cooling monobloc is equipped with channels for supply of the cooling media from the cooling media source to the cooling first side of the holder of a flat shape on the other opposite side of which the light source is mounted, while the main channel is arranged with the cooling media flow direction in parallel to longitudinal axis of cooling monobloc, and at least one secondary channel leads into the main channel under the first side of the light source holder.

Two secondary channels can preferably lead under the first side of the light source holder, arranged against each other or next to each other. The secondary channels can preferably lead into the main channel at the angle $\beta$, $\delta$=30°-90° with respect to the streaming direction of the cooling media through the main channel. The inner cooling fins of the cooling monobloc can preferably reach into the secondary channel between the source of the cooling media and the outlet of the secondary channel. The secondary channels can preferably at least partly comprise removable covers fitted with inner guiding and cooling fins or outer cooling fins. The cooling media source can be preferably mounted on the cooling monobloc fitted with a distribution partition to supply the cooling media separately to the main channel and separately to the secondary channel. The light source holder can be preferably inclined in the streaming direction of the cooling media at the angle $\varphi$=0°-60° with respect to the horizontal plane.

The light source cooler according to the invention exhibits higher transfer of neat from the light source to the cooling media and a significant improvement of cooling of the light source. The cooling media flows through the secondary channels where the inner fins of the cooling monobloc and the inner fins of the outer cover are arranged. The inner fins of the cooling monobloc dissipate heat from the streaming cooling media to the cooling monobloc, from which heat is further dissipated by the outer fins of the cooling monobloc by heat transfer to the ambient internal environment of the lamp. The inner fins arranged on the outer cover of the secondary channels dissipate heat into the outer cover and its outer fins from which heat is transferred to the ambient internal environment of the lamp. Thanks to the arrangement of the main channel and the secondary channels according to the invention, a greater quantity of cooling media is supplied to the cooled holder of the light source, at the opposite side of the holder with regard to the light source intensive turbulence of the cooling media occurs, resulting in better dissipation of heat from the light source. The arrangement of the cooling monobloc according to the invention makes the light source easy to replace. The source of cooling media according to the invention forms an integral part of the light source cooler.

BRIEF DESCRIPTION OF THE DRAWINGS

The light source cooler according to the invention is clarified with the use of drawings where.

DETAILED DESCRIPTION OF THE PREFERRED EMBODIMENTS

Figure 1:
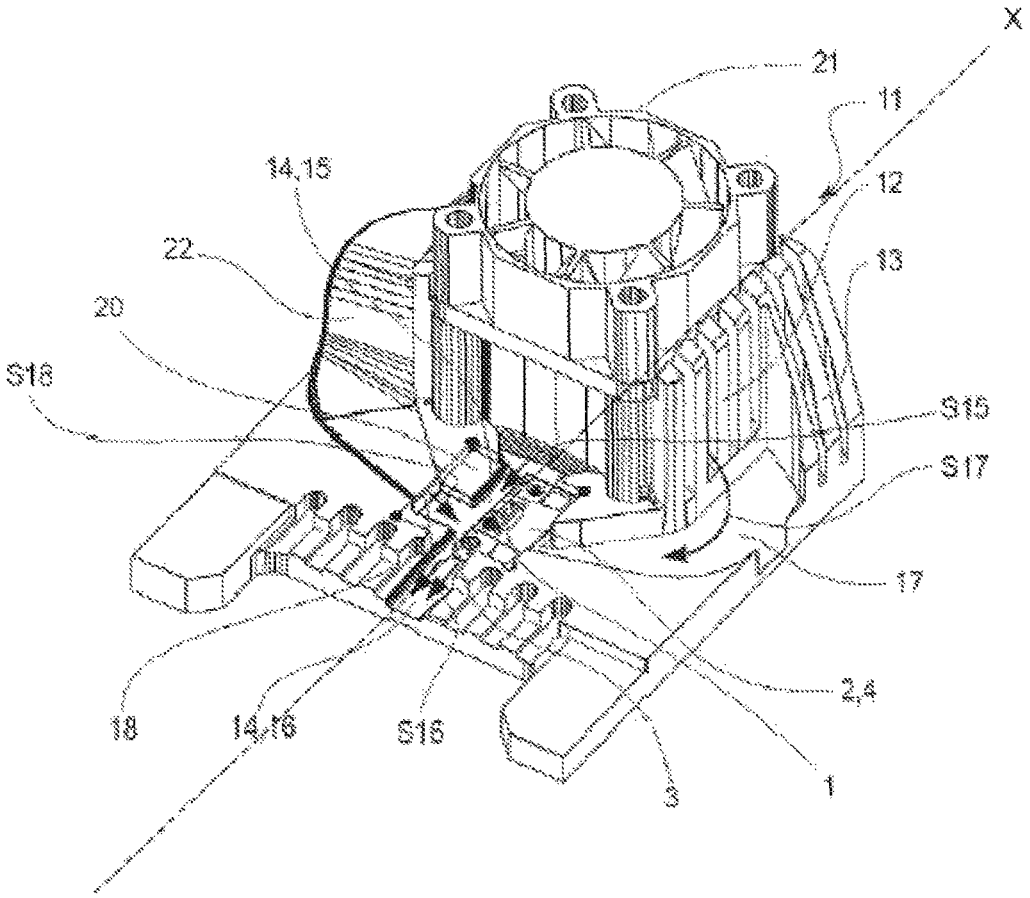
FIG. 1 shows a light source cooler in accordance with the present invention in a perspective view.
Figure 5:
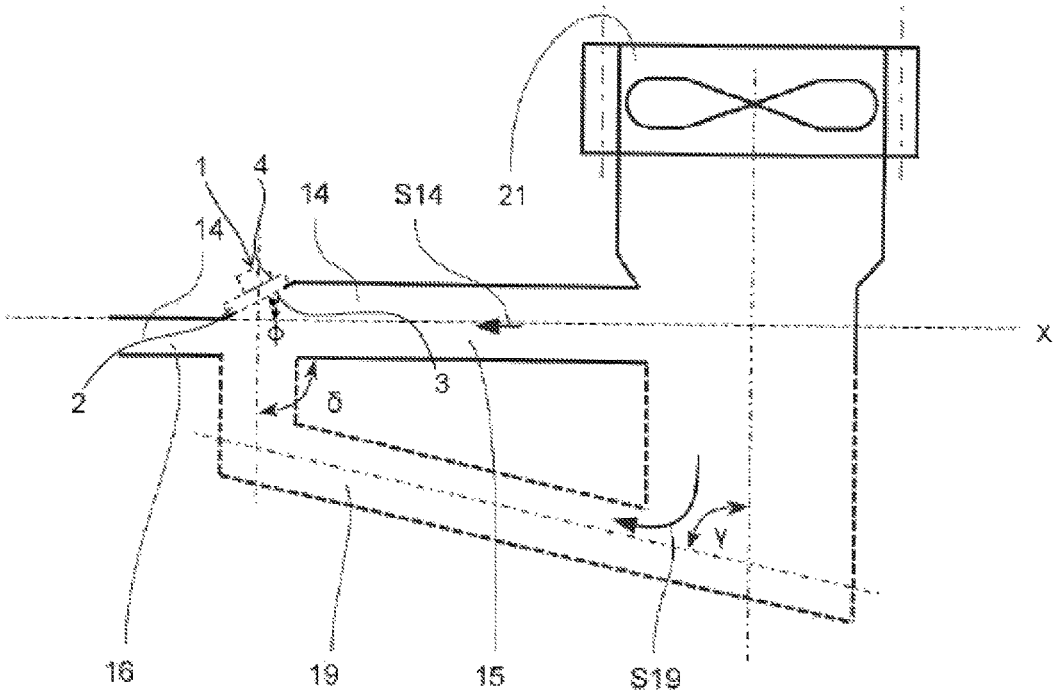
FIG. 5 shows a diagram of a bottom secondary channel of the present invention with the varying Holder inclination angle (φ).

FIG. 1 shows a light source cooler in a perspective view with a plastic cooling monobloc 11 made of a thermally conductive material with low thermal conductivity, up to 50 $W\ m^{-1}\ ^{\circ}\ K^{-1}$. The cooling monobloc 11 is equipped with outer fins 13 for heat transfer into the ambient environment, which is the enclosed internal space of the motor vehicle lamp. On the rear, elevated part of the cooling monobloc 11 the cooling media source 21 is mounted, which is preferably a fan. The source 21 blows cooling media into the cooling monobloc 11, where the cooling media stream is divided by a partition, which is not shown here, into two directions, namely the inlet part 15 of the main channel 14 the media flow being in the direction indicated by S15, and into the secondary channels 17, 18 through the inner cooling fins 12, which are part of the cooling monobloc 11. The inner cooling fins 12 of the cooling monobloc 11 reach into the secondary channels 17, 18 between the source 21 of cooling media and the outlet of the secondary channels 17, 18 into the main channel 14. The main channel 14 is arranged, with the cooling media flow direction, in parallel to longitudinal axis of cooling monobloc. Over the main channel 14, in the horizontal wall of the cooling monobloc, a recess 20 is created from the top, where a holder 2 of a flat plate-like shape is mounted. Reference 20 in FIG. 1 points to just a half of the recess 20, since the other half of the recess 20 is covered by a half of the holder 2 being depicted on the opposite side. As shown in FIG. 5, the holder 2 of the light source 1 can be inclined in the streaming direction of the cooling media at the angle φ=0°-60° with respect to the horizontal plane. In the place of the recess 20, the horizontal wall of the cooling monobloc 11 is interrupted and the bottom, first side 3 of the plate holder 2 thus encloses the main channel 14 from the top and is in contact with the cooling media, streaming through the main channel 14. On the other, top side 4 of the holder 2 the LED light source 1 is mounted. The secondary channels 17, 18 are routed out of the cooling monobloc 11 laterally with regard to the longitudinal axis x of the cooling monobloc 11, and then, following a break (see angle α in FIG. 3), they are directed and connected to the main channel 14 under the bottom, first side 3 of the plate holder 2, on the top, other side 4 of which the LED light source 1 is mounted. The two secondary channels 17, 18 lead into the area under the first side 3 of the holder 2 of the light source 1 laterally against each other, but they can lead there from the bottom, arranged next to each other. The secondary channels 17, 18 partly comprise removable covers 22 fitted with inner guiding and cooling fins 23, 24. The removable covers 22 can also or alternatively be fitted with outer cooling fins. The cooling media source 21 is mounted on the cooling monobloc 11, which is fitted with a distribution partition to supply the cooling media separately to the main channel 14 and separately to each secondary channel 17, 18.

Figure 2:
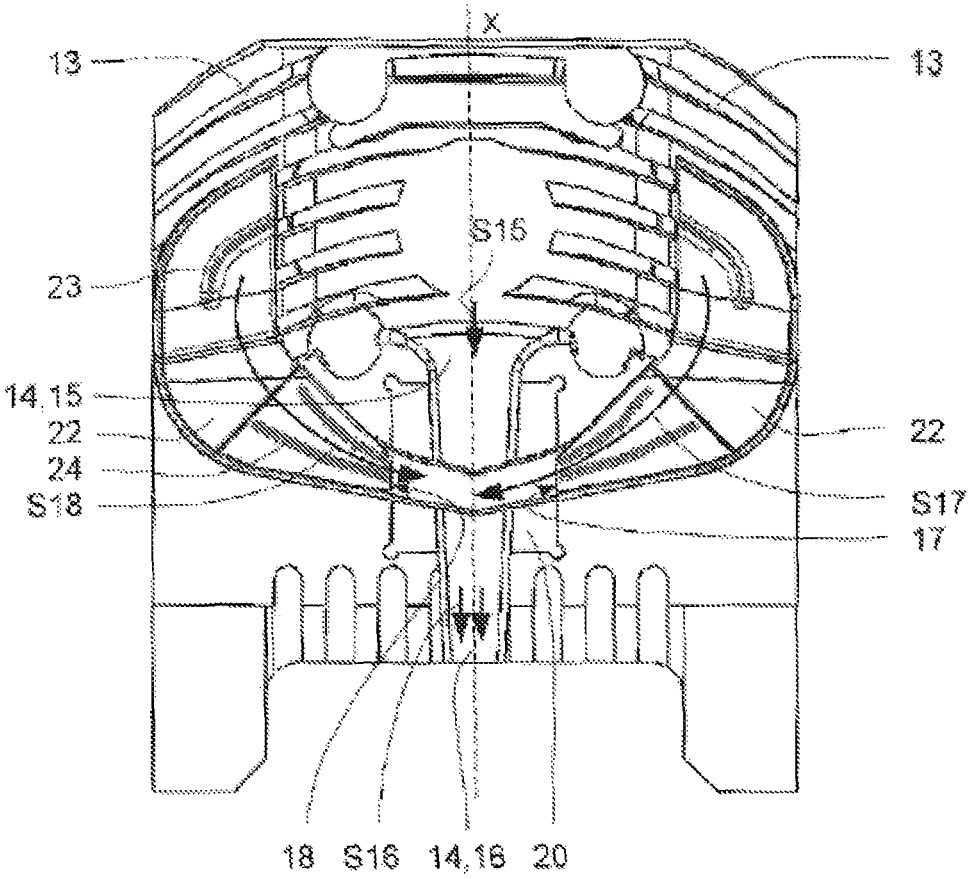
FIG. 2 shows covers of secondary channels in accordance with the present invention in a perspective view.

FIG. 2 shows the covers 22 of the secondary channels 17, 16 in a perspective view, arranged on the cooling monobloc 11. The covers 22 are fitted with inner guiding and cooling fins 23, 24 that guide the streaming cooling media on the one hand and dissipate heat from the streaming cooling media and cool it on the other hand. The cooling media flows through the secondary channels 17, 18 in the indicated directions S17, S18, leading perpendicularly from sides into the main channel 14 in the place under the plate holder 2 of the LED light source 1, which is not shown here. After mixing of the cooling media streams from the secondary channels 17, 18 with the cooling media stream in the main channel 14, the cooling media flows through the outlet part 16 of the main channel 14 in the flow direction indicated by S16.

Figure 3:
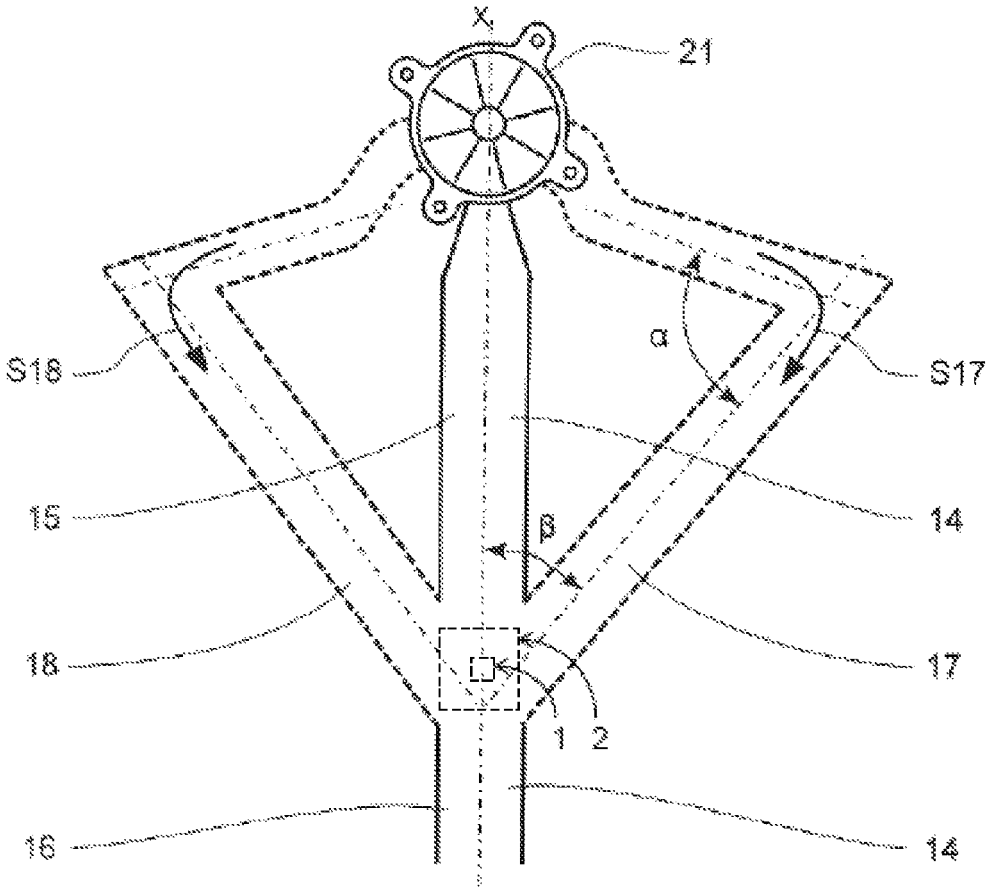
FIG. 3 shows a diagram of lateral secondary channels of the present invention.

FIG. 3 presents a diagram of the lateral secondary channels 17, 18, which are arranged in a break along the sides of the main channel 14. The lateral channels 17, 18 first lead from the side walls of the cooling media source 21, are broken at the angle α=0°-90° and lead into the main channel 14 from the lateral sides between the inlet part 15 and the outlet part 16 at the angle β=30°-90° with respect to the direction S14 of the cooling media flow through the main channel 14.

Figure 4:
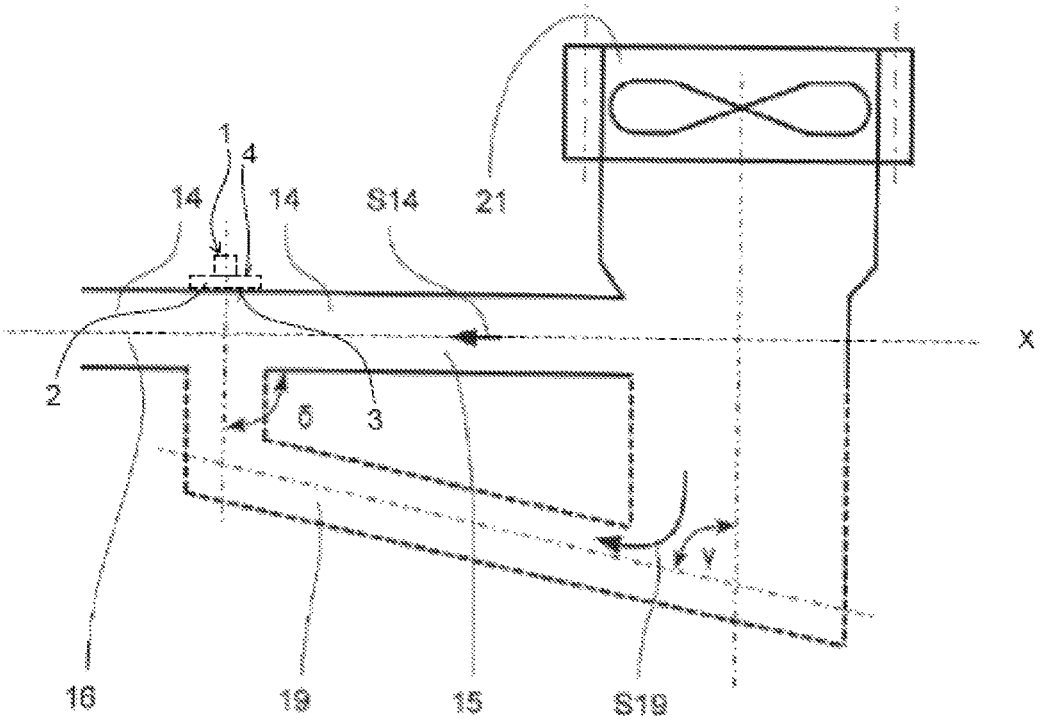
FIG. 4 shows a diagram of a bottom secondary channel of the present invention.

FIG. 4 presents a diagram of a bottom secondary channel 19, which is arranged under the main channel 14. The source 21 of cooling media supplies cooling media partly to the main channel 14 and partly to the secondary channel 19. The bottom secondary channel 19 leads from the cooling media source 21, and is broken at the angle γ=10°-80°. In the flow direction indicated by S19, the cooling media flows through the secondary channel 10 and its outlet into the horizontally arranged main channel 14. The secondary channel 19 is connected to the main channel e.g. at the angle δ=90° with regard to the direction S14 of the cooling media flow through the main channel 14. The angle d can be in the range δ=30°-90°.

LIST OF REFERENCE NUMBERS

1 Light source
2 Holder

3 First side
4 Second (opposite) side
11 Cooling monobloc
12 Inner cooling fin
13 Outer cooling fin
14 Main channel
15 Inlet part
16 Outlet part
17 Secondary channel
18 Secondary channel
19 Bottom secondary channel
20 Recess
21 Cooling media source
22 Cover
23 Guiding and cooling fin
24 Guiding and cooling fin
S14 Flow direction through the main channel 14
S15 Flow direction through the inlet part
S16 Flow direction through the outlet part
S17 Flow direction through the secondary channel 17
S18 Flow direction through the secondary channel 17
S19 Flow direction through the bottom secondary channel 17
Longitudinal axis X of the cooling monoblock 11
α Break angle of the secondary channel
β Outlet angle of the secondary channel
γ Inclination angle of the secondary channel
δ Outlet angle of the secondary channel
φ Holder inclination angle

The invention claimed is:

1. A lamp comprising a cooler and a light source, the cooler comprising:

(a) a heat conductive cooling monobloc (11) fitted with cooling elements (12, 13) for dissipation of heat;

(b) a holder (2) of the light source, wherein the holder (2) is arranged in the cooling monobloc (11) and the holder (2) comprises (i) a first side (3) formed by a bottom surface of the holder (2) and (ii) a second side (4) formed by a top surface of the holder (2); and (c) a cooling media source (21) for providing a cooling media to the cooling monobloc (11), wherein the light source is mounted on the second side (4) of the holder (2), wherein the cooling monobloc (11) comprises channels (14, 17, 18, 19) for supplying the cooling media from the cooling media source (21) to the first side (3) of the holder (2), wherein the channels (14, 17, 18, 19) comprise a main channel (14) positioned in parallel to a longitudinal axis (x) of the cooling monobloc (11) and at least two secondary channels (17, 18) flowing into the main channel (14) in an area under the first side (3) of the holder (2), wherein the secondary channels are arranged against each other or next to each other, wherein the cooling elements (12, 13) comprise inner cooling fins (12) reaching into the secondary channels (17, 18) between the cooling media source (21) and an outlet of the secondary channels (17, 18) into the main channel (14), and wherein the main channel (14) directs the cooling media away from the area under the first side (3) of the holder (2).

2. The cooler of a light source in accordance with claim 1, wherein the secondary channels (17, 18) intersects the main channel (14) at an angle of 30°-90° with respect to a streaming direction of the cooling media through the main channel (14).

3. The cooler of a light source in accordance with claim 1, wherein the secondary channels (17, 18) comprise a removable cover fitted with inner guiding and cooling fins (23, 24) and/or outer cooling fins.

4. The cooler of a light source in accordance with claim 1, wherein the cooling media source (21) is mounted on the cooling monobloc (11), wherein the cooling media source (21) is fitted with a distribution partition to supply the cooling media separately to the main channel (14) and separately to the secondary channels (17, 18, 19).

5. The cooler of a light source in accordance with claim 1, wherein the first side (3) of the holder (2) of the light source (1) is inclined at an angle of 0°-60° with respect to the longitudinal axis (x) of the cooling monobloc.

* * * * *